US005298185A

United States Patent [19]

Leonhardt et al.

[11] Patent Number: 5,298,185

[45] Date of Patent: Mar. 29, 1994

[54] AQUEOUS STABLE SUSPENSION OF WATER-INSOLUBLE SILICATES CAPABLE OF BINDING CALCIUM IONS AND THEIR USE FOR THE PRODUCTION OF WASHING AND CLEANING AGENTS

[75] Inventors: Wolfgang Leonhardt, Frankfurt; Roland Bergmann, Gross-Krotzenburg, both of Fed. Rep. of Germany

[73] Assignee: Degussa AG, Fed. Rep. of Germany

[21] Appl. No.: 853,179

[22] Filed: Mar. 17, 1992

[30] Foreign Application Priority Data

Mar. 22, 1991 [DE] Fed. Rep. of Germany ..... 4109501

[51] Int. Cl.[5] ..... C11D 3/08; C11D 3/16

[52] U.S. Cl. ..... 252/174.25; 252/174.19; 252/174.23; 252/173

[58] Field of Search ..... 252/174.21, 174.23, 252/174.25

[56] References Cited

U.S. PATENT DOCUMENTS

| | | | |
|---|---|---|---|
| 4,615,820 | 10/1986 | Hepworth et al. | 252/139 |
| 4,671,887 | 6/1987 | Diehl et al. | 282/174.25 |
| 4,846,992 | 7/1989 | Fonsny | 252/90 |
| 4,883,607 | 11/1989 | Diehl | 252/174.18 |
| 5,076,957 | 12/1991 | Diehl et al. | 252/174.24 |
| 5,182,044 | 1/1993 | Yanaba et al. | 252/174.24 |
| 5,205,757 | 4/1993 | Van de Pas | 252/173 |

FOREIGN PATENT DOCUMENTS 0120659 3/1984 European Pat. Off. .

OTHER PUBLICATIONS

European Search Report.

*Primary Examiner*—Paul Lieberman
*Assistant Examiner*—Michael P. Tierney
*Attorney, Agent, or Firm*—Cushman, Darby & Cushman

[57] ABSTRACT

Aqueous suspensions of a silicate capable of binding calcium ions, containing, based on the total weight of the suspension, a) as silicate, a compound corresponding to Formula I:

$$(Cat_{2/n}O)_x \cdot Me_2O_3 \cdot (SiO_2)_y \quad \text{(I) and}$$

B) as dispersing component, a mixture of at least two oxoalcohol ethoxylates corresponding to Formula II $$R-(OCH_2CH_2)_n-OH \quad \text{(II).}$$

wherein $R = C_{10}-C_{15}$ alkyl having a degree of branching of 0 to 90% linear and 100 to 10% single methyl branches n = 3–5.25 mol ethoxy groups in Component 1 n = 5.5–7.0 mol ethoxy groups in Component 2

C) a polyethylene glycol having an average molecular weight of from 200 to 2000.

6 Claims, No Drawings

AQUEOUS STABLE SUSPENSION OF WATER-INSOLUBLE SILICATES CAPABLE OF BINDING CALCIUM IONS AND THEIR USE FOR THE PRODUCTION OF WASHING AND CLEANING AGENTS

The present invention relates to an aqueous, pumpable, stable suspension of a water-insoluble silicate which is capable of binding calcium ions, and to the use of that suspension in the manufacture of washing and cleaning agents.

BACKGROUND OF THE INVENTION

Washing and cleaning agents are known in which calcium complex binding finely divided water insoluble aluminum silicates are used for partly or completely binding calcium phosphates in complexes. Generally these aluminum silicates contain bound water and are capable of binding calcium. They may be used for washing and cleaning solid materials, in particular textiles (see Published German Patent Application DE-OS 24 12 837—cf. British Patents 1,473,201 and 1,473,202).

These aluminum silicates are compounds corresponding to the general formula I:

$$(Cat_{2/n}O)_x \cdot Me_2O_3 \cdot (SiO_2)_y \quad (I),$$

in which Cat is a cation of valency n which is replaceable by calcium, x denotes a number from 0.7 to 1.5, Me stands for aluminum and y denotes a number from 0.8 to 6, preferably from 1.3 to 4.

The cation used is preferably sodium but it may be replaced by lithium, potassium, ammonium or magnesium.

The above-defined compounds capable of binding calcium will hereinafter be referred to as "aluminum silicates" or "AS" for the sake of simplicity. This applies in particular to the sodium aluminum silicates which are preferably used; all particulars given for their use according to the invention and all particulars concerning their preparation and properties also apply correspondingly to all compounds defined above.

The aluminum silicates which are particularly suitable for use in washing and cleaning agents have a calcium binding capacity of preferably 50 to 200 mg of CaO/g for the anhydrous aluminum silicate. When reference is made hereinafter to anhydrous aluminum silicate, this term is intended to denote the state of the aluminum silicates reached after one hour's drying at 800° C. In the course of this drying, the water adhering to the aluminum silicates and the bound water are removed virtually completely.

In the production of washing and cleaning agents containing the aluminum silicates defined above, in addition to the usual components of such agents, the aluminum silicates used as starting material are preferably moist, for example they may be still moist from their production process. The moist compounds are mixed with at least part of the other components of the agent to be produced and the mixture is converted into the finished washing or cleaning agent required as end product, for example a free-flowing product, by known measures such as, for example, spray drying.

For the process outlined above for the production of washing or cleaning agents, the aluminum silicates may be delivered and used in the form of, for example, an aqueous suspension. Certain improvements in the properties of the aluminum silicates dispersed in the aqueous phase, as a suspension, are desirable, e.g. in improving the stability of the suspension and the pumpability.

It is known to use alkyl phenol ethylene adducts for the formation of aluminum silicate suspensions (DE-A 26 15 698). However, owing to ecological awareness, attention is being paid increasingly to biodegradability.

It is known from Published German Patent Application DE-A 32 09 631 (cf. U.S. Pat. No. 4,486,331) to use nonyl phenol ethoxylates for the foregoing purpose. These compounds are regarded as difficultly degradable on account of their benzene ring and their branched nonyl group, and in particular they entail the risk of formation of toxic nonyl phenol as a metastable degradation product. Nonyl phenol ethoxylates have therefore not been used by the German detergent industry.

It is also known from Published German Patent Application DE-A 34 44 311 (cf. U.S. Pat. No. 4,671,887) to use isotridecyl alcohol ethoxylates for the foregoing purpose. These are branched chain alcohols having a degree of branching of at least 50% and consist of an indeterminable isomeric mixture, often with all possible forms of branching such as methyl, ethyl, propyl, isopropyl, etc.

It is known from Published German Patent Application DE-A 37 19 042 to use a mixture of two oxoalcohol ethoxylates corresponding to the formula $R—(OCH_2—CH_2)_n—OH$, but these have the disadvantage that the viscosity of the resulting suspension at room temperature is too high at high solids concentrations.

SUMMARY OF THE INVENTION

In accordance with the present invention, the foregoing difficulties are alleviated with an aqueous, pumpable, stable suspension of a water insoluble silicate capable of binding calcium ions, in which, based on the total weight of the aqueous suspension, there are:

A) as silicate capable of binding calcium, from 0.5 to 80% by weight of a finely divided, synthetically produced, water-insoluble compound containing bound water, corresponding to the general formula I $$(Cat_{2/n}O)_x \cdot Me_2O_3 \cdot (SiO_2)_y, \quad (I),$$

wherein Cat denotes a cation of valency n which is replaceable by calcium, x denotes a number from 0.7 to 1.5, Me stands for boron or aluminum and y denotes a number from 0.5 to 6, and B) as dispersing component, a mixture of at least two components, both oxoalcohol ethoxylates corresponding to formula II:

$$R—(OCH_2CH_2)_n—OH \quad (II)$$

wherein $R = C_{10}$–$C_{15}$ alkyl having a degree of branching of from 0 to 90% linear and 0 to 10% single methyl branches, and n=3–5.25 mol of ethoxy groups (hereinafter "EO") in the first of said components, (hereinafter "Component 1") and n=5.5–7.0 mol of EO in the second of said components (hereinafter "Component 2"), and C) a polyethylene glycol having an average molecular weight of from 200 to 2000, components B and C amounting to 0.5 to 6% by weight, preferably 1 to 2% by weight, in particular 1.4% to 1.6% by weight, based on the weight of the suspension.

Component A in the suspension according to the invention may be crystalline.

In Formula I of Component A, y may stand for a number from 1.3 to 4.

In a preferred embodiment, the crystalline component A may be a type A zeolite.

The compounds mentioned above are the essential components of the suspension according to the invention.

The suspension may, however, also contain other components, e.g., foam inhibiting additives or so-called solubilizing agents, i.e. compounds which improve the solubility of the added dispersing agents in the aqueous phase. The foam inhibitors used may be the usual foam inhibiting substances, e.g. foam inhibiting soap, silicone defoamants, and foam inhibiting triazine derivatives, all of which are known and commonly used in the art. The addition of such a substance is generally not necessary, but it may be desirable in the case of foaming dispersing agents, in particular when relatively large quantities of alkyl benzene sulfonic acid are used.

The addition of a solubilizing substance is also generally unnecessary but may be indicated if the suspension according to the invention contains a hydrophilic but only sparingly water-soluble colloid as stabilizing agent, e.g. a polyvinyl alcohol. For example, a solubilizing agent is advantageously used, sodium toluene sulfonate being very suitable.

The proportion of solubilizing agent in the whole suspension may, for example, be of the same order of magnitude as the proportion of stabilizing agent. Other compounds suitable as solubilizing agents are well known in the art; hydrotropic agents such as, for example, benzene sulfonic acid, xylene sulfonic acid and their water-soluble salts as well as octyl sulfate are suitable.

All the particulars given concerning the "concentration of the aluminum silicates", the "solids content" or the "active substance content" (=AS) are based on the state of the aluminum silicates reached after one hour's drying at 800° C. In this drying process, the water adhering to the aluminum silicates and the bound water are removed virtually completely.

Component A may consist of amorphous or crystalline products; mixtures of amorphous and crystalline products as well as partially crystalline products may, of course, also be used. The aluminum silicates may be naturally occurring products or synthetically produced products, synthetically produced products being preferred. They may be produced by, for example, by the reaction of water-soluble silicates with water-soluble aluminates in the presence of water. For this purpose, aqueous solutions of the starting materials may be mixed together or one component present in the solid state may be reacted with the other component present as an aqueous solution. If water is present, the desired aluminum silicates are also obtained by mixing the two components present in the solid state. Aluminum silicates may also be prepared from $Al(OH)_3$, $Al_2O_3$ or $SiO_2$ by their reaction with alkali metal silicate or aluminate solutions. The aluminum silicates may also be produced by other known processes. The invention relates in particular to aluminum silicates which have a three dimensional space lattice structure.

The preferred calcium binding capacity, which is in the range of about 100 to 200 mg CaO/g of AS but is in most cases about 100 to 180 mg CaO/g of AS is found mainly in compounds having the following composition:

$$0.7-1.1\ Na_2O \cdot Al_2O_3 \cdot 1.3-3.3\ SiO_2.$$

This overall formula covers two types of different crystal structures (or their non-crystalline precursors) which are also distinguished by their overall formulae, which are as follows:

a) $0.7-1.1\ Na_2O \cdot Al_2O_3 \cdot 1.3-2.4\ SiO_2.$ b) $0.7-1.1\ Na_2O \cdot Al_2O_3 \cdot 2.4-3.3\ SiO_2.$ The different crystal structures can be seen in the X-ray diffraction diagrams.

The amorphous or crystalline aluminum silicate present in aqueous suspension may be separated from the remaining aqueous solution by filtration and dried at temperatures of e.g. 50° to 400° C. The product contains a variable quantity of bound water, depending on the drying conditions used.

Such high drying temperatures are generally not to be recommended; it is advisable not to go beyond 200° C. if the aluminum silicate is intended for use in washing and cleaning agents.

For preparing a suspension according to the invention, the aluminum silicates need not be dried at all after their preparation; instead, and this is particularly advantageous, an aluminum silicate still moist from its preparation may be used. However, aluminum silicates may also be used for preparing suspensions according to the invention which have been dried at moderate temperatures, for example at 80° to 200° C., until the liquid water adhering to them has been removed.

The particle size of the individual aluminum silicate particles may vary and may lie e.g. in the range of from 0.1μ to 0.1 mm. It is particularly advantageous to use aluminum silicates containing at least 80% by weight of particles measuring from 10 to 0.01μ.

These aluminum silicates preferably contain no primary or secondary particles having diameters above 45μ. "Secondary particles" are particles which result from the aggregation of primary particles to form larger structures.

In view of the risk of agglomeration of the primary particles into larger structures, the use of aluminum silicates which are still moist from their preparation has proved to be particularly satisfactory for the preparation of the suspensions according to the invention as it has been found that the formation of agglomerates is virtually completely prevented when these still-moist products are used.

In a particularly preferred embodiment of the invention, pulverulent type A zeolite having a specially defined particle spectrum is used as component A.

Such zeolite powders may be prepared according to the following Published German Patent Applications:

DE-AS 24 47 021 (cf. British Patent 1,517,323), DE-AS 25 17 218 (cf. U.S. Pat. No. 4,073,867), DE-OS 26 52 419, DE-OS 26 51 420 (cf. U.S. Pat. No. 4,303,626), DE-OS 26 51 436 (c.f. U.S. Pat. No. 4,305,916), DE-OS 26 51 437 (c.f. U.S. Pat. No. 4,303,627), DE-OS 26 51 445 (cf. British Patent 1,517,535) and DE-OS 26 51 485 (cf. U.S. Pat. No. 4,304,629). They then have the particle distribution curves indicated there.

In a particularly preferred embodiment, a pulverulent type A zeolite having the particle size distribution described in DE-OS 26 51 485 may be used.

The concentration of component A is preferably from 44 to 55% by weight, in particular 46 to 52% by weight or more.

Component B may preferably consist of a mixture of two oxoalcohol ethoxylates, one component being an oxoalcohol ethoxylate containing 3 to 5.25 mol of ethylene oxide and having a turbidity point of 56°-68.5° C., preferably containing 4-5 mol of EO and having a turbidity point of 60°-67° C., in which the carbon chain R has 10-15, preferably 12-13 carbon atoms, and the second component (B) being an oxoalcohol ethoxylate containing 5.5-7.0 mol of ethylene oxide and having a turbidity point of from 70.5°-80° C., preferably containing 5.75-6.5 mol of EO and a turbidity point of from 71°-77° C., in which the carbon chain R has 10-15, preferably 12-13 carbon atoms.

The oxoalcohol ethoxylates (Components 1 and 2) may be mixed together in a ratio of from 9:1 to 1:9, preferably from 2:3 to 3:2, in particular from 0.9:1.1 to 1.1:0.9.

The concentration of components B and C in the aqueous suspension is preferably from 1 to 2% by weight, in particular from 1.4 to 1.6% by weight. This concentration is sufficient to stabilize a suspension having a solids content of 50% by weight or more.

Component C may be used in a quantity of from 3 to 20% by weight, preferably from 5 to 15% by weight (based on the quantity of stabilizer consisting of components B and C). In a preferred embodiment, the average molecular weight of the polyethylene glycol may be from 200 to 1000.

The suspension according to the invention has the advantage that it is resistant to sedimentation in the temperature range below 25° C. and has a pumpable consistency.

Another advantage is that the oxoalcohol ethoxylate is liquid at room temperature and therefore need not be heated.

It is a particular advantage that substantially higher solids contents of 50% by weight and more can be obtained in the suspension according to the invention.

A very special advantage is the use of polyethylene glycol in the stabilizer mixture. The stability of the zeolite suspension is unaffected by the addition of polyethylene glycol in quantities of up to 15%; it is only when polyethylene glycol is added in a quantity of 20% or more that the stabilizing effect of the surfactant mixture decreases. On the other hand, the addition of polyethylene glycol has unexpectedly positive effects on the viscosity and especially on the outflow characteristics. The addition of from 5-15% of polyethylene glycol is an optimum amount for the stability, the viscosity and the outflow characteristics.

The aqueous suspensions may in principle contain comparatively small quantities of other substances in addition to the above-mentioned components A and B and in addition to starting materials possibly still present from the preparation of these components. If the suspension is to be converted into washing and cleaning agents, the additional substances present should, of course, preferably be substances which are suitable for use as components for washing and cleaning agents.

The suspensions may be prepared by simply mixing their components, among which the aluminum silicates may, for example, be used as such or in a moist state, for example still moist from their preparation, or as an aqueous suspension. It is particularly advantageous to stir component B into the aluminum silicates which are still moist from their preparation, e.g. as filter cakes.

On the other hand, aluminum silicates which have already been dried, i.e., freed from water adhering to them but possibly still containing bound water, may, of course, also be used.

The suspensions according to the invention are distinguished by high stability and other advantages.

A particularly valuable stabilizing effect is obtained with aluminum silicates having particle sizes of from 1 to 30μ. The suspensions are pumpable so that moist aluminum silicate can easily be handled. The suspensions remain perfectly pumpable even if the pumping process has been interrupted for a considerable time. Owing to their high stability, the suspensions can be transported in conventional tank trucks without any risk of formation of unusable or interfering residues. The suspensions are thus a very suitable form of aluminum silicates for delivery, for example, to manufacturers of detergents.

The suspensions according to the invention are particularly suitable for further working up into pourable or free flowing, pulverulent products which appear dry, for example for the production of pulverulent aluminum silicates. No troublesome residues occur when the aqueous suspensions are conveyed to the drying apparatus. Further, it has been found that suspensions according to the invention can be worked up into extremely dust-free products.

Owing to their exceptional stability, the suspensions according to the invention may be used as such, i.e., without further working up with or without further washing, bleaching and/or cleaning additives, for example as water softeners, washing or cleaning agents and in particular as mild liquid scouring agents with increased suspension stability.

One particularly important use of the suspension is its conversion into pourable or free-flowing pulverulent washing and cleaning agents which appear dry and which contain other compounds in addition to the components of the suspension.

The suspensions according to the invention are suitable in particular for the production of pulverulent washing and cleaning agents.

These agents are produced from an aqueous, flowable preliminary mixture of the individual components of the agents, which is converted into a free-flowing product by the usual methods. For this purpose, the aluminum silicates defined above are used in the form of the suspensions according to the invention. These suspensions according to the invention may be converted into solid, free-flowing washing and cleaning agents by any known processes.

The production of pulverulent, free-flowing washing and cleaning agents can be carried out by mixing a suspension according to the invention, for example taken from a storage container, with at least one washing, bleaching or cleaning component of the agent to be produced and then converting the mixture into the pulverulent product by any desired process. A complex-forming agent is advantageously added, i.e., a compound which is capable of binding, by complex formation, the alkaline earth metal ions which are responsible for the hardness of water, in particular magnesium and calcium ions.

For the production of washing and cleaning agents, the suspension according to the invention is as a general rule preferably combined with at least one water soluble surfactant not belonging to the possible constituents of component B.

There are several possible variations for the production of washing and cleaning agents.

For example, suspensions according to the invention may be combined with substances capable of binding water of crystallization, preferably by spraying the compounds capable of binding water of crystallization, which have been introduced into a mixer, with the suspension so that after constant mixing a solid product which appears dry is finally obtained.

Suspensions according to the invention are, however, preferably mixed as a slurry with at least one other compound which has a washing or cleaning action and then spray dried. Other surprising advantages of the aluminum silicate suspension claimed are found when this procedure is carried out; it has been found that products which produce very little dust can be obtained when the suspensions according to the invention are spray dried in this form. The products obtained by spray drying have a high calcium binding capacity and are easily wetted.

Washing agents which have been produced using the suspension according to the invention may have a wide variety of compositions. They generally contain at least one watersoluble surfactant not belonging to the dispersing agents used according to the invention which are present in the claimed aluminum silicate suspensions. In addition to at least one other compound which has a washing, bleaching or cleaning action and which may be organic or inorganic, the washing agents generally contain an aluminum silicate conforming to the above definition as a calcium binding compound. Further, such agents may contain other conventional auxiliary agents and additives which are in most cases present in relatively small quantities.

DETAILED DESCRIPTION OF PREFERRED EMBODIMENTS

The following examples illustrate the invention:

A zeolite A filter cake and stabilizer are stirred together, optionally with the addition of water.

Components B and C are used as stabilizer. The degree of ethoxylation is indicated as EO. The zeolite A filter cake used is prepared according to DE-OS 26 51 485 and has the particle size spectrum indicated there.

For carrying out the examples, 50 kg of unstabilized zeolite suspension is stirred for one hour at 500 rpm, optionally with the addition of water, using an Ekato-Standard mix stirrer equipped with a bladed disc.

After the addition of 1.5% by weight of stabilizer mixture, stirring is continued for 10 minutes at the same speed.

The turbidity points of the stabilizers used are given in Table I. Table I

Turbidity points according to DIN 53 917 of the oxoalcohol ethoxylates used (5 g of surfactant in 25 g of a 5% butyl diglycol solution)

| | |
|---|---|
| $C_{12/13}$-Oxoalcohol - 4.25 EO | 63.5° C. |
| $C_{12/13}$-oxoalcohol - 5.75 EO | 72.5° C. |

The surfactants contain 1% of polyethylene glycol (PEG) from their process of preparation. To test the influence of PEG on the stability and flow properties, PEGs having an average molecular weight of 800 are added in such quantities to the 1:1 mixture of the two individual surfactants that the total PEG content is 7% or 15% or 20% by weight. The stability tests are carried out after 3 days (Table 2) while viscosity tests and outflow tests are carried out on the same day (Tables 3 and 4).

TABLE II

Stabilization of zeolite suspension with oxoalcohol ethoxylates having a $C_{12/13}$ chain length (solids content of the zeolite suspension: 49%)

| | Oxoalcohol 4.25/5.75 EO 1% PEG | Oxoalcohol 4.25/5.75 EO 7% PEG | Oxoalcohol 4.25/5.75 EO 15% PEG | Oxoalcohol 4.25/5.75 EO 20% PEG |
|---|---|---|---|---|
| Resting time (days) | 3/3 | 3/3 | 3/3 | 3/3 |
| Temperature (°C.) | 22/45 | 22/45 | 22/45 | 22/45 |
| Clear Phase (mm) | 2/5 | 2/5 | 3/7 | 5/10 |
| Homogeneity | 1/1 | 1/1 | 1/1 | 2/2 |
| Flow behaviour | 2/2 | 2/2 | 2/2 | 4/3 |
| Ground sediment (mm) | -/- | -/- | -/- | -/- |

The homogeneity and flow behaviour are assessed on the basis of school marks (1 = very good to 5 = deficient)

TABLE III

Viscosity measurements on stabilized zeolite suspensions at different temperatures (measuring instrument: Brookfield RVT, Spindle 4)

| | Oxoalcohol 4.25/5.75 EO 1% PEG | | | Oxoalcohol 4.25/5.75 EO 7% PEG | | | Oxoalcohol 4.25/5.57 EO 15% PEG | | | Oxoalcohol 4.25/5.75 EO 20% PEG | | |
|---|---|---|---|---|---|---|---|---|---|---|---|---|
| Revs/min | 5 | 20 | 50 | 5 | 20 | 50 | 5 | 20 | 50 | 5 | 20 | 50 |
| 10° C. | 1600 | 820 | 600 | 1000 | 600 | 440 | 1000 | 550 | 400 | 1000 | 550 | 400 |
| 25° C. | 400 | 180 | 120 | 400 | 200 | 120 | 400 | 200 | 120 | 400 | 200 | 120 |
| 40° C. | 280 | 150 | 120 | 280 | 150 | 100 | 280 | 150 | 100 | 280 | 150 | 100 |

TABLE IV

Determination of the outflow times from DIN cup 4 (DIN 53 211) at 22° C.

| | Oxoalcohol 4.25/5.75 EO 1% PEG | Oxoalcohol 4.25/5.75 EO 7% PEG | Oxoalcohol 4.25/5.75 EO 15% PEG | Oxoalcohol 4.25/5.75 EO 20% PEG |
|---|---|---|---|---|
| 10° C. | 61 | 51 | 55 | 57 |
| 25° C. | 28 | 25 | 24 | 25 |
| 40° C. | 20 | 19 | 19 | 19 |

We claim:

1. An aqueous pumpable stable suspension of a water-insoluble silicate capable of binding calcium ions, which contains, based on the total weight of the aqueous suspension, A) as silicate capable of binding calcium, from 0.5 to 80 percent by weight of a finely divided, synthetically produced, water-insoluble compound containing bound water, corresponding to the general formula I $$(Cat_{2/n}O)_x \cdot Me_2O_3 \cdot SiO_2)_y \quad (I)$$

wherein Cat denotes a cation of valency n which is replaceable by calcium, x denotes a number from 0.7 to 1.5, Me stands for boron or aluminum and y denotes a number from 0.8 to 6 and B) as dispersing component, a mixture of two oxoalcohol ethoxylates corresponding to formula II $$R—(OCH_2CH_2)_n—OH \quad (II)$$

wherein $R=C_{10}-C_{15}$ alkyl having a degree of branching of from 1 to 90% linear and from 100 to 10% of single methyl branches, n=3-5.25 mol of ethoxy groups in the first of said components B, said first component B being an oxoalcohol ethoxylate having a turbidity point of 56°-68.5° C. and a carbon chain R containing 10-15 carbon atoms and n=5.5-7.0 mol of ethoxy groups in the second of said components B, said second component B being an oxoalcohol ethoxylate haivng a turbidity point of from 70.5° to 50° C. and a carbon chain R containing 10-15 carbon atoms, and C) a polyethylene glycol having an average molecular weight of from 200 to 2000, the amount of said Component C being from 3 to 20% by weight based on the quantity of stabilizer consisting of components B and C, components B and C amounting to 0.5 to 6% by weight, based on the suspension.

2. A suspension according to claim 1, in which component A is crystalline.

3. A suspension according to claim 1 or claim 2, in which, in formula I of component A, y stands for a number from 1.3 to 4.

4. A suspension according to claim 1 or claim 2 in which component A is a zeolite A.

5. A suspension according to claims 1 or claim 2 in which the first of said components B contains 4 to 5 mol of ethoxy groups and has a turbidity point of 60°-67° C., the carbon chain R of the first of said components B having 12-13 carbon atoms, and in which the second of said components B contains 5.75 to 6.5 mol of ethoxy groups and has a turbidity point of 71° to 77° C., the carbon chain of the second of said components B having 12-13 carbon atoms.

6. A suspension according to claim 2, in which the ration in which the two $C_{12}-C_{15}$ oxoalcohol ethoxylates are mixed in component B is from 9:1 to 1:9.

* * * * *